US011255299B2

(12) United States Patent
Reinhart et al.

(10) Patent No.: US 11,255,299 B2
(45) Date of Patent: Feb. 22, 2022

(54) SYSTEMS AND METHODS FOR AN EXHAUST GAS RECIRCULATION VALVE CARTRIDGE IN AN INTEGRATED EXHAUST MANIFOLD CYLINDER HEAD

(71) Applicant: Ford Global Technologies, LLC, Dearborn, MI (US)

(72) Inventors: Paul Thomas Reinhart, Livonia, MI (US); Chad Michael Strimpel, Maybee, MI (US); Justin Craft, Royal Oak, MI (US); Gianluca Mantovano, Oak Park, MI (US); Jacob Andrew Pleshe, Dearborn, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 155 days.

(21) Appl. No.: 16/428,555

(22) Filed: May 31, 2019

(65) Prior Publication Data

US 2020/0378347 A1 Dec. 3, 2020

(51) Int. Cl.

| | |
|---|---|
| ***F02M 26/30*** | (2016.01) |
| ***F02F 1/24*** | (2006.01) |
| ***F02M 26/73*** | (2016.01) |
| ***F02M 26/41*** | (2016.01) |
| ***F02F 1/38*** | (2006.01) |

(52) U.S. Cl.

CPC ..... *F02M 26/30* (2016.02); *F02F 1/243* (2013.01); *F02F 1/38* (2013.01); *F02M 26/41* (2016.02); *F02M 26/73* (2016.02)

(58) Field of Classification Search

CPC ..... F02M 26/30; F02M 26/41; F02M 26/73; F02M 26/65; F02M 26/22; F02F 1/243; F02F 1/38

See application file for complete search history.

(56) References Cited

U.S. PATENT DOCUMENTS

| | | | | |
|---|---|---|---|---|
| 6,478,017 | B2 * | 11/2002 | Bianchi | F02M 26/31 123/568.11 |
| 6,752,133 | B2 | 6/2004 | Arnell | |
| 7,942,138 | B1 * | 5/2011 | Belter | F02M 26/41 123/568.12 |
| 8,939,174 | B2 | 1/2015 | Sponsky et al. | |
| 9,664,153 | B2 | 5/2017 | Beyer et al. | |

(Continued)

FOREIGN PATENT DOCUMENTS

| | | | | |
|---|---|---|---|---|
| CN | 204755047 | U | 11/2015 | |
| EP | 2063097 | A1 * | 5/2009 | F02M 26/32 |
| JP | 2000161131 | A * | 6/2000 | F02F 1/243 |

*Primary Examiner* — Ngoc T Nguyen

(74) *Attorney, Agent, or Firm* — Geoffrey Brumbaugh McCoy Russell LLP

(57) ABSTRACT

Systems and methods are provided for an exhaust gas recirculation (EGR) system in a vehicle. In one example, a system may include a cylinder head including an integrated exhaust manifold (IEM), an EGR cartridge including an EGR valve positioned in the cylinder head at a central collector region of the IEM, and a water jacket formed within the cylinder head, the water jacket including at least one cooling passage that extends around a circumference of the EGR cartridge. In this way, an EGR system is provided that has a reduced volume between an exhaust valve of a cylinder to the EGR valve, reducing packaging space and complexity of the EGR system while increasing engine performance.

20 Claims, 9 Drawing Sheets

(56) References Cited

U.S. PATENT DOCUMENTS

| | | | | |
|---|---|---|---|---|
| 2010/0175374 | A1* | 7/2010 | Steiner | F02B 33/44<br>60/598 |
| 2012/0085300 | A1* | 4/2012 | Asano | F02M 26/12<br>123/41.82 R |
| 2017/0276095 | A1* | 9/2017 | Beyer | F02M 26/32 |
| 2019/0211780 | A1* | 7/2019 | Sakamoto | F02F 1/14 |

* cited by examiner

SYSTEMS AND METHODS FOR AN EXHAUST GAS RECIRCULATION VALVE CARTRIDGE IN AN INTEGRATED EXHAUST MANIFOLD CYLINDER HEAD

FIELD

The present description relates generally to systems and methods for an engine having an integrated exhaust manifold and an exhaust gas recirculation system.

BACKGROUND/SUMMARY

Vehicle engine systems may utilize an external exhaust gas recirculation (EGR) system to reduce NOx emissions and increase engine efficiency. For example, the external EGR system may couple an engine exhaust manifold to an engine intake manifold via an EGR passage. An EGR valve disposed within the EGR passage may be controlled to achieve a desired intake air dilution for the given engine operating conditions (e.g., engine speed, engine load, and engine temperature) to maintain desirable combustion stability while providing emissions and fuel economy benefits.

However, traditional EGR systems are difficult to package within typical engine layouts. For example, an exhaust feed from the exhaust manifold may flow to a separately housed EGR valve and motor control assembly that is mounted on an external surface of the engine, requiring brackets and extensive packaging space. Additionally, complex cooling circuits and passages, such as drilled passages and plugs, may be used to cool components of the EGR system (e.g., the EGR valve), adding to the packaging space and system complexity. Overall, the extensive packaging layout adds additional weight to the vehicle, increases component and assembly costs, and reduces a performance of the EGR system.

Other attempts to reduce the packaging space and complexity of an EGR system include integrating an EGR passage into a cylinder head. One example approach is shown by Arnell et al. in U.S. Pat. No. 6,752,133 B2. Therein, an EGR passage is arranged in the cylinder head, with an EGR valve disposed therein on an intake manifold-side of the cylinder head. The inclusion of the EGR passage and the EGR valve in the cylinder head enables cooling via cooling features of the cylinder head.

However, the inventors herein have recognized potential issues with such systems. As one example, placing the EGR valve on the intake manifold side may reduce engine performance versus close coupling of the EGR valve to the exhaust manifold. As another example, the system of Arnell does not show where the EGR valve is placed relative to the cooling features of the cylinder head. The inventors herein have recognized that careful consideration of the cooling features, and not just the EGR valve positioning, is integral to the function of the EGR system, as inadequate cooling may result in EGR valve degradation.

In one example, the issues described above may be addressed by a system, comprising: a cylinder head including an integrated exhaust manifold (IEM); an exhaust gas recirculation (EGR) cartridge positioned in a cylindrical bore in the cylinder head at a central collector region of the IEM, the EGR cartridge including an EGR valve positioned therein; and a water jacket enclosed within the cylinder head, the water jacket including a first cooling passage that surrounds a circumference of the EGR cartridge. In this way, the cylinder head water jacket is specifically engineered to cool the EGR cartridge, enabling the EGR cartridge to be integrated in the cylinder head to decrease a packaging space and complexity of the external EGR system.

As one example, the EGR cartridge includes a cylindrical housing, and the housing forms an EGR flow path such that, when the EGR valve is open, exhaust gas may flow from the IEM and through the housing to an EGR passage integrated within the cylinder head. The EGR valve may be a poppet valve, and a bottom of the housing may form a valve seat for the poppet valve so that the exhaust gas may flow into the housing via the bottom when the poppet valve is lifted from the valve seat. The EGR passage may be coupled to an opening in a side of the housing that enables the exhaust gas to flow out of the housing and to the EGR passage, which may be further coupled to EGR system components that are external to the cylinder head (e.g., an EGR cooler). Further, the EGR cartridge may be arranged in a cylindrical bore in the cylinder head that extends from a top surface of the cylinder head to the IEM to fluidically couple the EGR cartridge to the IEM. As another example, a thermal conductor may be positioned between the EGR cartridge and the cylindrical bore and in direct contact with both the housing of the EGR cartridge and the cylindrical bore (e.g., metal of the cylinder head) to efficiently transfer heat between the EGR cartridge components and the cylinder head. As still another example, the water jacket may further include a second cooling passage positioned vertically above the first cooling passage that surrounds a portion of the circumference of the EGR cartridge. For example, the second cooling passage may be an additional water jacket core that is dedicated to cooling the EGR cartridge. In this way, the EGR cartridge may be cooled without complex cooling circuits and passages, reducing component and assembly costs while reducing overall vehicle weight. Further, by positioning the EGR valve within the cylinder head and directly fed by the IEM, engine performance may be increased.

It should be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

BRIEF DESCRIPTION OF THE DRAWINGS

FIGS. 2-7 are shown approximately to scale.

DETAILED DESCRIPTION

Figure 1A:
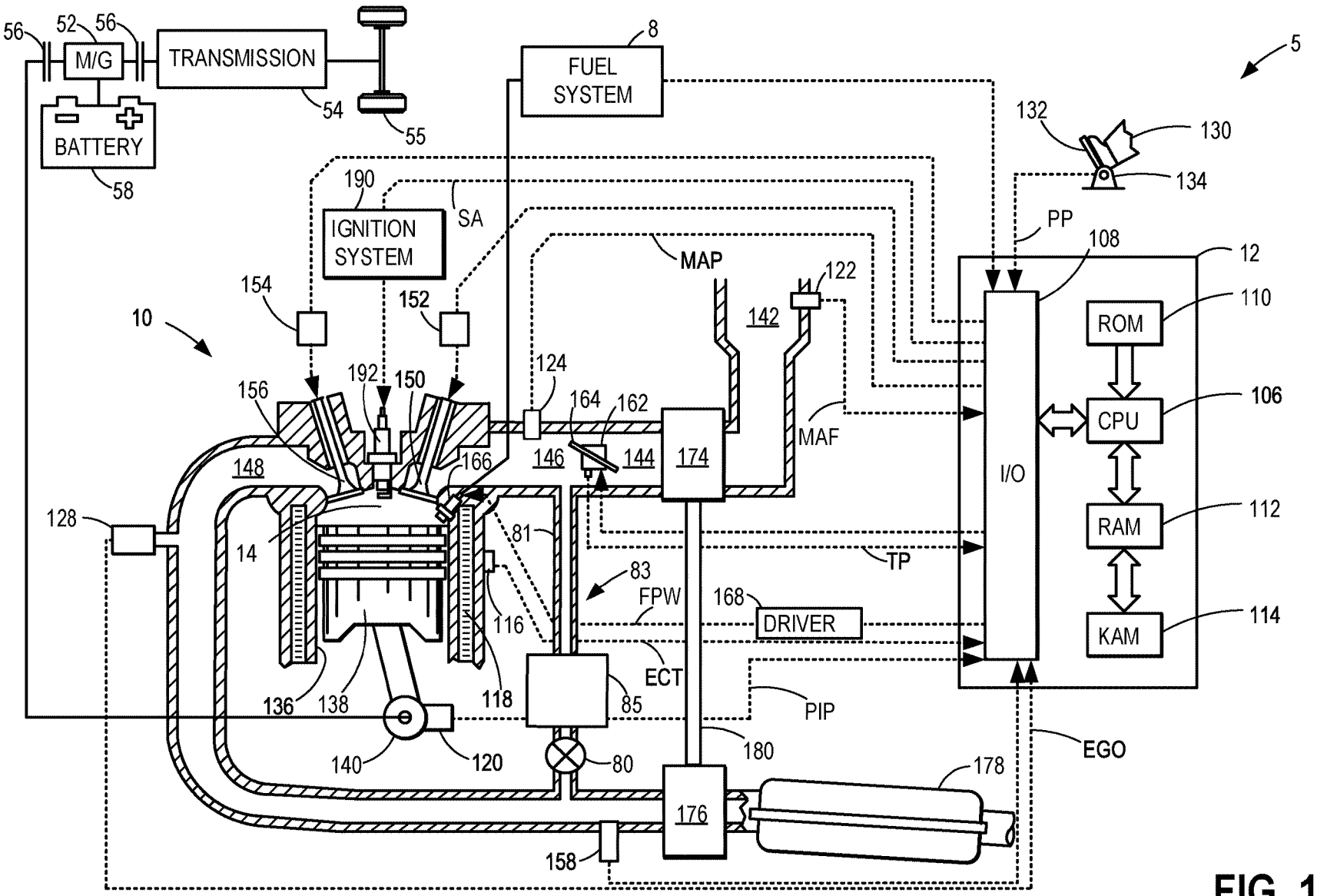
FIG. 1A shows a schematic depiction of an example vehicle system.
Figure 2:
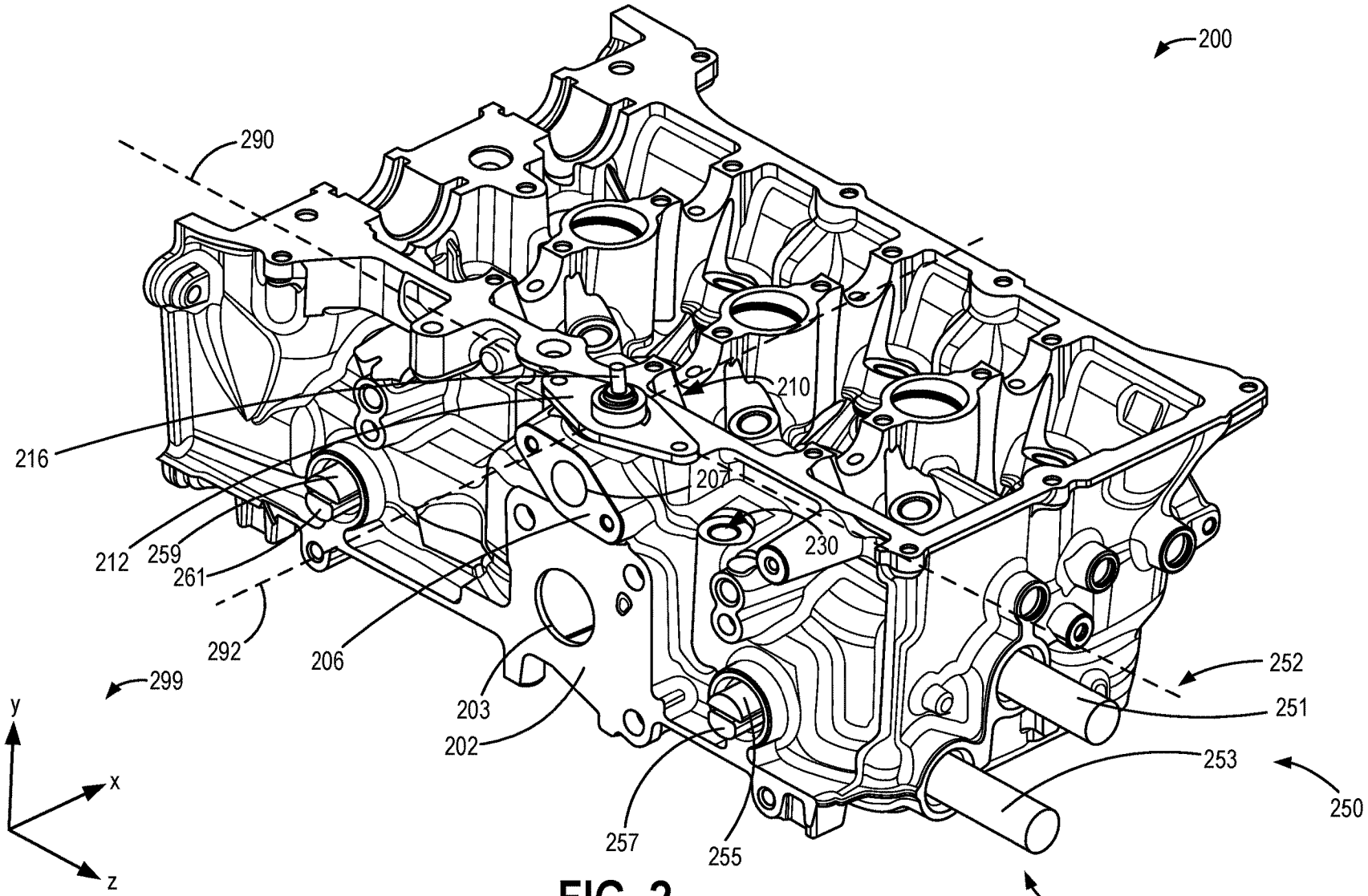
FIG. 2 shows a perspective view of a cylinder head having an integrated exhaust manifold and an EGR valve cartridge packaged therein.
Figure 3:
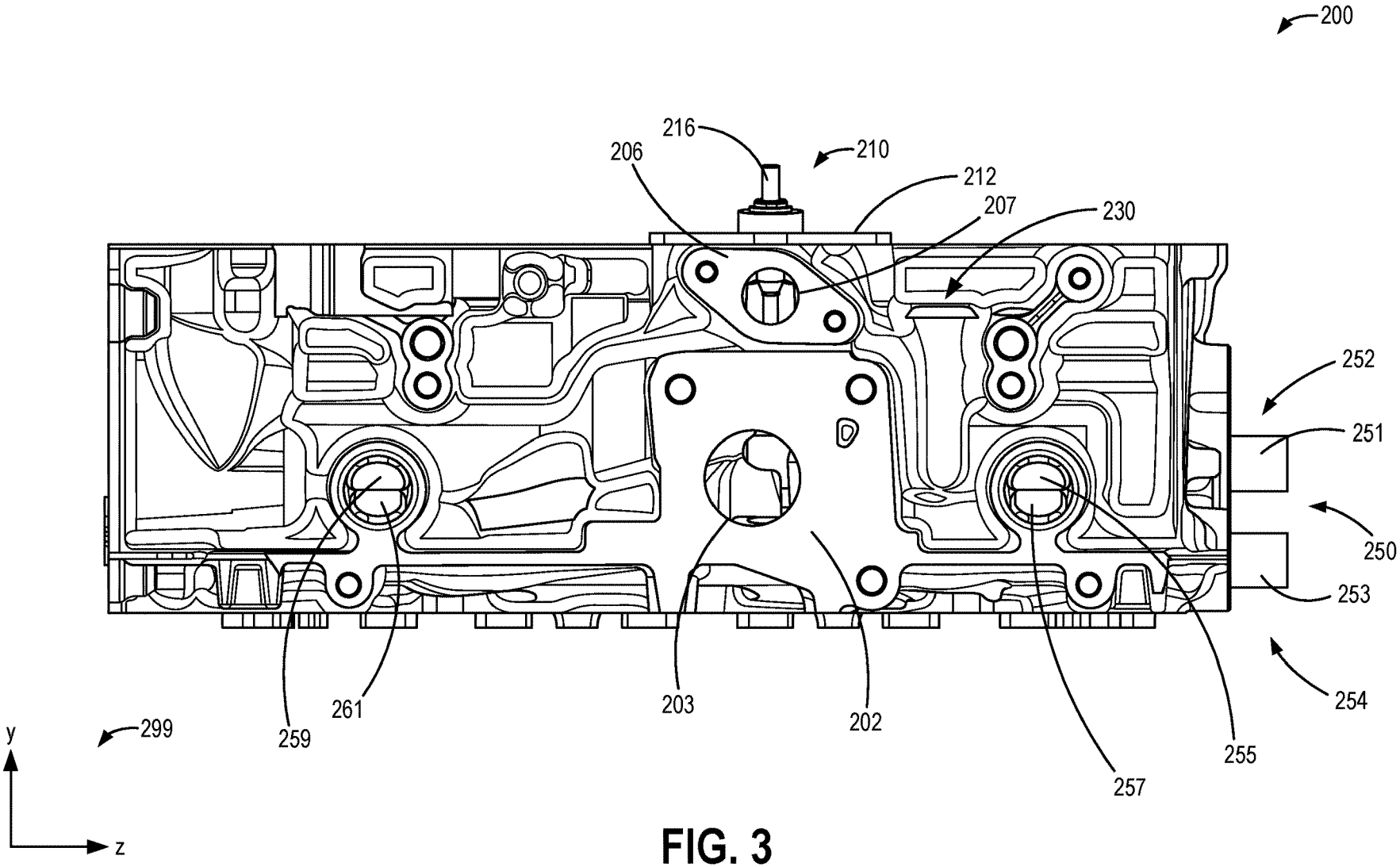
FIG. 3 shows a side view of the cylinder head of FIG. 2.
Figure 6:
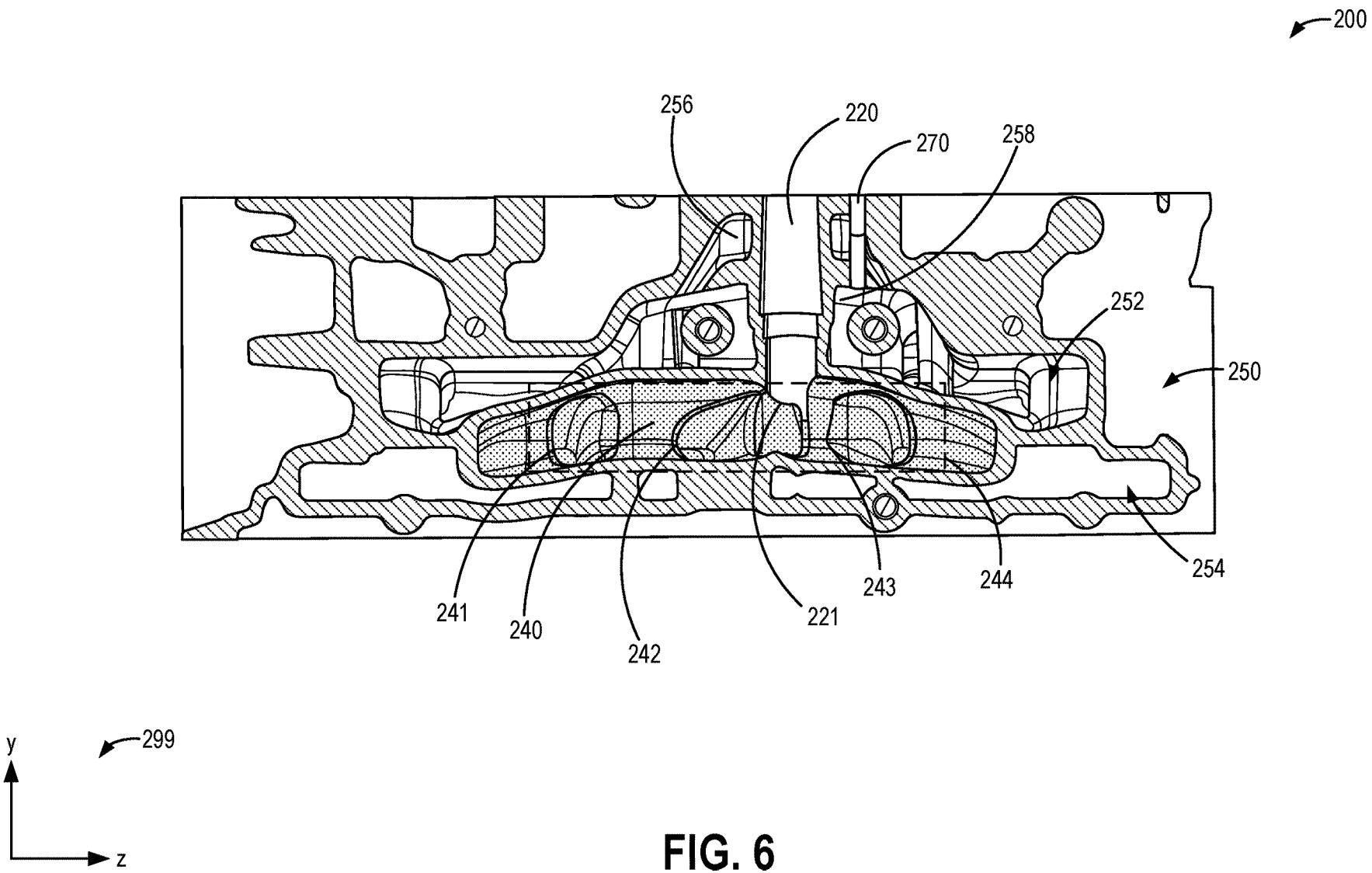
FIG. 6 shows a partial section view of the cylinder head of FIGS. 2 and 3 that highlights passages cast into the cylinder head.
Figure 7:
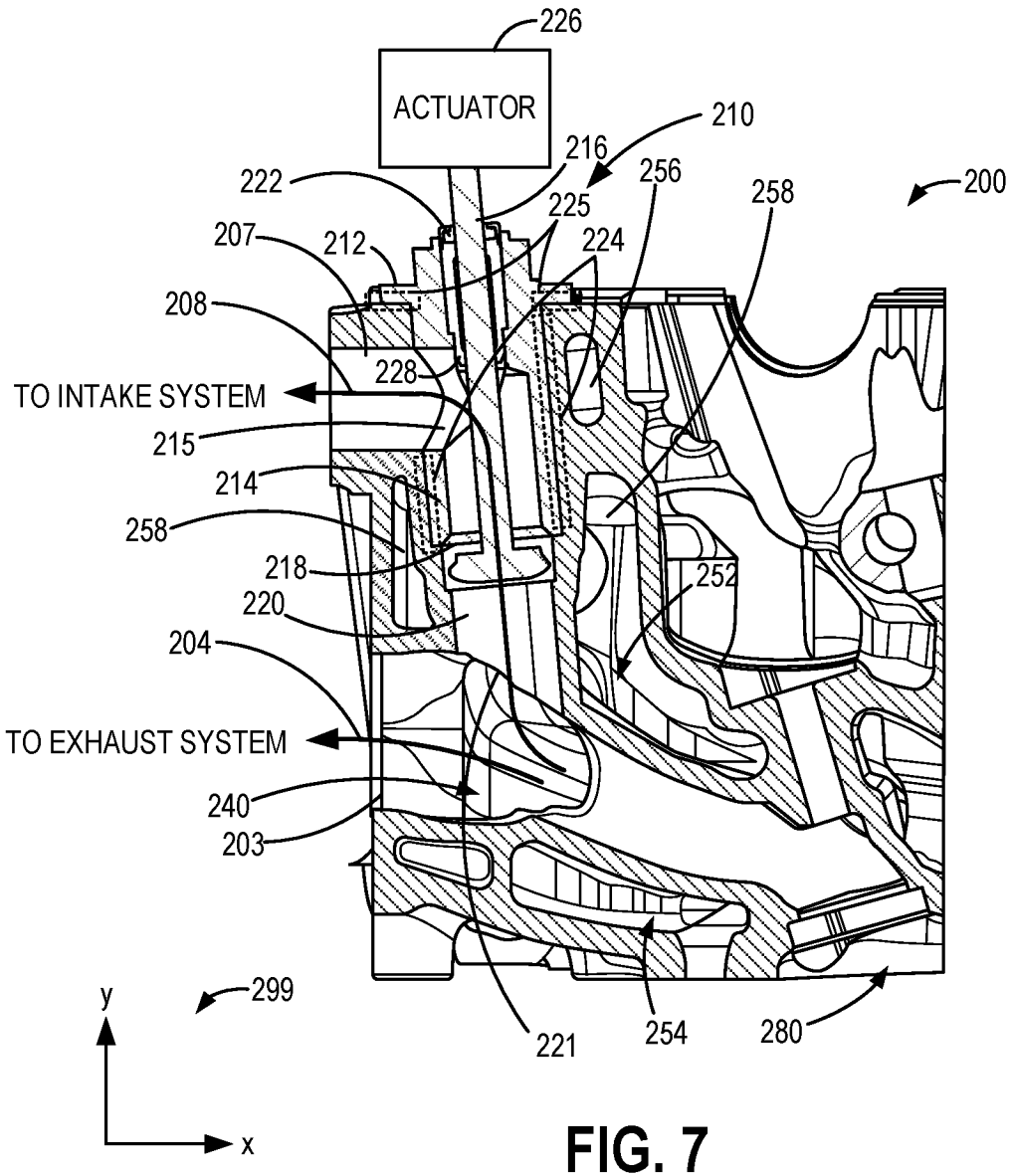
FIG. 7 shows a partial section view of the cylinder head of FIGS. 2 and 3 that highlights internal components of the EGR valve cartridge.
Figure 8:
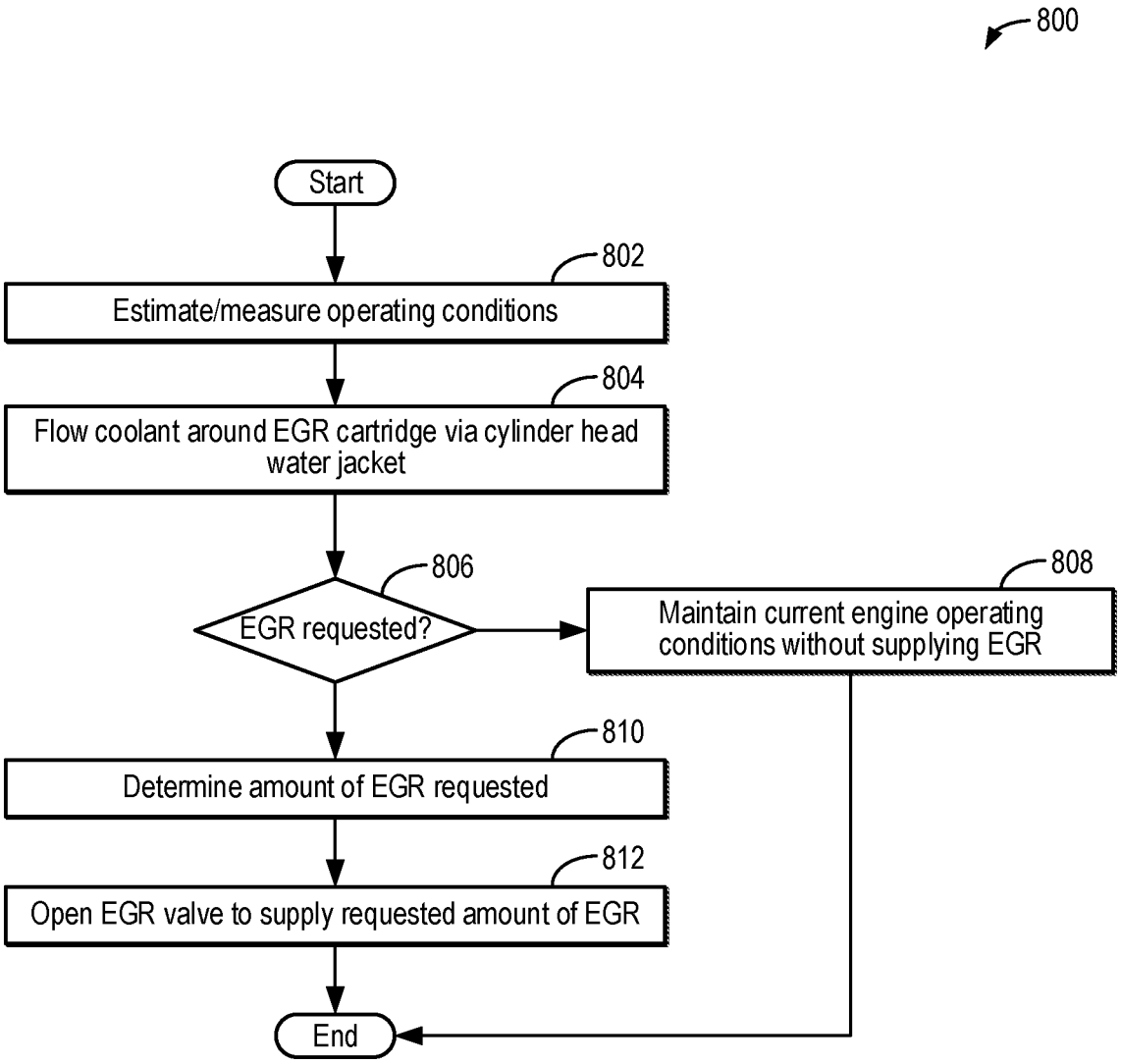
FIG. 8 is a flow chart of an example method for providing exhaust gas recirculation in an engine having an EGR valve packaged in a cylinder with an integrated exhaust manifold.

The following description relates to systems and methods for providing recirculated exhaust gas in a vehicle engine, such as the engine shown in FIG. 1A. The engine may be cooled by a cooling system located in an under-hood compartment of the vehicle, such as the example engine cooling system shown in FIG. 1B. The engine may include a cylinder head having an integrated exhaust manifold and an EGR valve cartridge packaged therein. External views of the cylinder head are shown in FIGS. 2 and 3. The EGR valve cartridge may be cooled by a water jacket contained within the cylinder head, eliminating a need for an external EGR valve cooling circuits, as particularly shown in FIGS. 4 and 5. FIGS. 6 and 7 show partial section views of the cylinder head, highlighting internal surfaces of the integrated exhaust manifold, the water jacket, and the EGR cartridge. In particular, FIG. 7 shows how exhaust gas may flow from an engine cylinder to the EGR valve cartridge, reducing a total volume from the engine cylinder to the EGR valve cartridge as well as reducing a flow path length. FIG. 8 shows a method for providing EGR to the engine via the EGR valve cartridge while cooling the EGR valve cartridge via the cylinder head water jacket.

FIG. 1A schematically shows an example cylinder 14 of an internal combustion engine 10, which may be included in a vehicle 5. Engine 10 may be controlled at least partially by a control system, including a controller 12, and by input from a vehicle operator 130 via an input device 132. In this example, input device 132 includes an accelerator pedal and a pedal position sensor 134 for generating a proportional pedal position signal PP. Cylinder (herein, also "combustion chamber") 14 of engine 10 may include combustion chamber walls 136 with a piston 138 positioned therein. Piston 138 may be coupled to a crankshaft 140 so that reciprocating motion of the piston is translated into rotational motion of the crankshaft. Crankshaft 140 may be coupled to at least one vehicle wheel 55 via a transmission 54, as further described below. Further, a starter motor (not shown) may be coupled to crankshaft 140 via a flywheel to enable a starting operation of engine 10.

In some examples, vehicle 5 may be a hybrid vehicle with multiple sources of torque available to one or more vehicle wheels 55. In other examples, vehicle 5 is a conventional vehicle with only an engine. In the example shown, vehicle 5 includes engine 10 and an electric machine 52. Electric machine 52 may be a motor or a motor/generator. Crankshaft 140 of engine 10 and electric machine 52 are connected via transmission 54 to vehicle wheels 55 when one or more clutches 56 are engaged. In the depicted example, a first clutch 56 is provided between crankshaft 140 and electric machine 52, and a second clutch 56 is provided between electric machine 52 and transmission 54. Controller 12 may send a signal to an actuator of each clutch 56 to engage or disengage the clutch, so as to connect or disconnect crankshaft 140 from electric machine 52 and the components connected thereto, and/or connect or disconnect electric machine 52 from transmission 54 and the components connected thereto. Transmission 54 may be a gearbox, a planetary gear system, or another type of transmission.

The powertrain may be configured in various manners including as a parallel, a series, or a series-parallel hybrid vehicle. In electric vehicle embodiments, a system battery 58 may be a traction battery that delivers electrical power to electric machine 52 to provide torque to vehicle wheels 55. In some embodiments, electric machine 52 may also be operated as a generator to provide electrical power to charge system battery 58, for example, during a braking operation. It will be appreciated that in other embodiments, including non-electric vehicle embodiments, system battery 58 may be a typical starting, lighting, ignition (SLI) battery coupled to an alternator.

Cylinder 14 of engine 10 can receive intake air via a series of intake air passages 142, 144, and 146. Intake air passage 146 can communicate with other cylinders of engine 10 in addition to cylinder 14. In some examples, one or more of the intake passages may include a boosting device, such as a turbocharger or a supercharger. For example, FIG. 1A shows engine 10 configured with a turbocharger, including a compressor 174 arranged between intake passages 142 and 144 and an exhaust turbine 176 arranged along an exhaust passage 148. Compressor 174 may be at least partially powered by exhaust turbine 176 via a shaft 180 when the boosting device is configured as a turbocharger. In some examples, exhaust turbine 176 may be a variable geometry turbine (VGT) where turbine geometry is actively varied by actuating turbine vanes as a function of engine speed and other operating conditions. In one example, the turbine vanes may be coupled to an annular ring, and the ring may be rotated to adjust a position of the turbine vanes. In another example, one or more of the turbine vanes may be pivoted individually or pivoted in plurality. As an example, adjusting the position of the turbine vanes may adjust a cross sectional opening (or area) of exhaust turbine 176. However, in other examples, such as when engine 10 is provided with a supercharger, compressor 174 may be powered by mechanical input from a motor or the engine, and exhaust turbine 176 may be optionally omitted.

A throttle 162 including a throttle plate 164 may be provided in the engine intake passages for varying the flow rate and/or pressure of intake air provided to the engine cylinders. For example, throttle 162 may be positioned downstream of compressor 174, as shown in FIG. 1A, or may be alternatively provided upstream of compressor 174. A throttle position sensor may be provided to measure a position of throttle plate 164.

Exhaust passage 148 can receive exhaust gases from other cylinders of engine 10 in addition to cylinder 14. An exhaust gas sensor 128 is shown coupled to exhaust passage 148 upstream of an emission control device 178. Exhaust gas sensor 128 may be selected from among various suitable sensors for providing an indication of an exhaust gas air/fuel ratio (AFR), such as a linear oxygen sensor or UEGO (universal or wide-range exhaust gas oxygen), a two-state oxygen sensor or EGO (as depicted), a HEGO (heated EGO), a NOx sensor, a HC sensor, or a CO sensor, for example. Emission control device 178 may be a three-way catalyst, a NOx trap, various other emission control devices, or combinations thereof.

External exhaust gas recirculation (EGR) may be provided to the engine via a high pressure EGR system 83, delivering exhaust gas from a zone of higher pressure in exhaust passage 148, upstream of turbine 176, to a zone of lower pressure in intake air passage 146, downstream of compressor 174 and throttle 162, via an EGR passage 81. An amount EGR provided to intake air passage 146 may be varied by controller 12 via an EGR valve 80. For example, controller 12 may be configured to actuate and adjust a position of EGR valve 80 to adjust the amount of exhaust gas flowing through EGR passage 81. EGR valve 80 may be adjusted between a fully closed position, in which exhaust gas flow through EGR passage 81 is blocked, and a fully open position, in which exhaust gas flow through the EGR passage is enabled. As an example, EGR valve 80 may be continuously variable between the fully closed position and the fully open position. As such, the controller may increase a degree of opening of EGR valve 80 to increase an amount of EGR provided to intake air passage 146 and decrease the degree of opening of EGR valve 80 to decrease the amount of EGR provided to intake air passage 146. As an example, EGR valve 80 may be an electronically activated solenoid valve. In other examples, EGR valve 80 may be positioned by an incorporated stepper motor, which may be actuated by controller 12 to adjust the position of EGR valve 80 through a range of discreet steps (e.g., 52 steps), or EGR valve 80 may be another type of flow control valve.

Under some conditions, the EGR system may be used to regulate the temperature of the air and fuel mixture within the combustion chamber. Further, EGR may be desired to attain a desired engine dilution, thereby improving fuel efficiency and emissions quality, such as emissions of nitrogen oxides. As an example, EGR may be requested at low-to-mid engine loads. Thus, it may be desirable to measure or estimate the EGR mass flow. EGR sensors may be arranged within EGR passage 81 and may provide an indication of one or more of mass flow, pressure, and temperature of the exhaust gas, for example. Additionally, EGR may be desired after emission control device 178 has attained its light-off temperature. An amount of EGR requested may be based on engine operating conditions, including engine load (as estimated via pedal position sensor 134), engine speed (as estimated via a crankshaft acceleration sensor), engine temperature (as estimated via an engine coolant temperature sensor 116), etc. For example, controller 12 may refer to a look-up table having the engine speed and load as the input and output a desired amount of EGR corresponding to the input engine speed-load. In another example, controller 12 may determine the desired amount of EGR (e.g., desired EGR flow rate) through logic rules that directly take into account parameters such as engine load, engine speed, engine temperature, etc. In still other examples, controller 12 may rely on a model that correlates a change in engine load with a change in a dilution requirement, and further correlates the change in the dilution requirement with a change in the amount of EGR requested. For example, as the engine load increases from a low load to a mid load, the amount of EGR requested may increase, and then as the engine load increases from a mid load to a high load, the amount of EGR requested may decrease. Controller 12 may further determine the amount of EGR requested by taking into account a best fuel economy mapping for a desired dilution rate. After determining the amount of EGR requested, controller 12 may refer to a look-up table having the requested amount of EGR as the input and a signal corresponding to a degree of opening to apply to the EGR valve (e.g., as sent to the stepper motor or other valve actuation device) as the output.

EGR may be cooled via passing through EGR cooler 85 within EGR passage 81. EGR cooler 85 may reject heat from the EGR gases to engine coolant, for example. Because EGR valve 80 is positioned upstream of EGR cooler 85, EGR valve 80 may be referred to as a "hot side" EGR valve. An example EGR system configuration will be described below with respect to FIGS. 2-7.

Each cylinder of engine 10 may include one or more intake valves and one or more exhaust valves. For example, cylinder 14 is shown including at least one intake poppet valve 150 and at least one exhaust poppet valve 156 located at an upper region of cylinder 14. In some examples, each cylinder of engine 10, including cylinder 14, may include at least two intake poppet valves and at least two exhaust poppet valves located at an upper region of the cylinder. Intake valve 150 may be controlled by controller 12 via an actuator 152. Similarly, exhaust valve 156 may be controlled by controller 12 via an actuator 154. The positions of intake valve 150 and exhaust valve 156 may be determined by respective valve position sensors (not shown).

During some conditions, controller 12 may vary the signals provided to actuators 152 and 154 to control the opening and closing of the respective intake and exhaust valves. The valve actuators may be of an electric valve actuation type, a cam actuation type, or a combination thereof. The intake and exhaust valve timing may be controlled concurrently, or any of variable intake cam timing, variable exhaust cam timing, dual independent variable cam timing, or fixed cam timing may be used. When can actuation is used, each cam actuation system may include one or more cams and may utilize one or more of cam profile switching (CPS), variable cam timing (VCT), variable valve timing (VVT), and/or variable valve lift (VVL) systems that may be operated by controller 12 to vary valve operation. For example, cylinder 14 may alternatively include an intake valve controlled via electric valve actuation and an exhaust valve controlled via cam actuation, including CPS and/or VCT. In other examples, the intake and exhaust valves may be controlled by a common valve actuator (or actuation system) or a variable valve timing actuator (or actuation system).

Cylinder 14 can have a compression ratio, which is a ratio of volumes when piston 138 is at bottom dead center (BDC) to top dead center (TDC). In one example, the compression ratio is in the range of 9:1 to 10:1. However, in some examples, such as where different fuels are used, the compression ratio may be increased. This may happen, for example, when higher octane fuels or fuels with higher latent enthalpy of vaporization are used. The compression ratio may also be increased if direct injection is used due to its effect on engine knock.

In some examples, each cylinder of engine 10 may include a spark plug 192 for initiating combustion. An ignition system 190 can provide an ignition spark to combustion chamber 14 via spark plug 192 in response to a spark advance signal SA from controller 12, under select operating modes. A timing of signal SA may be adjusted based on engine operating conditions and driver torque demand. For example, spark may be provided at or near maximum brake torque (MBT) timing to maximize engine power and efficiency. Controller 12 may input engine operating conditions, including engine speed and engine load, into a look-up table and output the corresponding MBT timing for the input engine operating conditions, for example.

In some examples, each cylinder of engine 10 may be configured with one or more fuel injectors for providing fuel thereto. As a non-limiting example, cylinder 14 is shown including a fuel injector 166. Fuel injector 166 may be configured to deliver fuel received from a fuel system 8. Fuel system 8 may include one or more fuel tanks, fuel pumps, and fuel rails. Fuel injector 166 is shown coupled directly to cylinder 14 for injecting fuel directly therein in proportion to the pulse width of a signal FPW received from controller 12 via an electronic driver 168. In this manner, fuel injector 166 provides what is known as direct injection (hereafter also referred to as "DI") of fuel into cylinder 14.

While FIG. 1A shows fuel injector 166 positioned to one side of cylinder 14, fuel injector 166 may alternatively be located overhead of the piston, such as near the position of spark plug 192. Such a position may increase mixing and combustion when operating the engine with an alcohol-based fuel due to the lower volatility of some alcohol-based fuels. Alternatively, the injector may be located overhead and near the intake valve to increase mixing. Fuel may be delivered to fuel injector 166 from a fuel tank of fuel system 8 via a high pressure fuel pump and a fuel rail. Further, the fuel tank may have a pressure transducer providing a signal to controller 12.

In an alternate example, fuel injector 166 may be arranged in intake air passage 146 rather than coupled directly to cylinder 14 in a configuration that provides what is known as port injection of fuel (hereafter also referred to as "PFI") into an intake port upstream of cylinder 14. In yet other examples, cylinder 14 may include multiple injectors, which may be configured as direct fuel injectors, port fuel injectors, or a combination thereof. As such, it should be appreciated that the fuel systems described herein should not be limited by the particular fuel injector configurations described herein by way of example.

Fuel injector 166 may be configured to receive different fuels from fuel system 8 in varying relative amounts as a fuel mixture and further configured to inject this fuel mixture directly into cylinder 14. Further, fuel may be delivered to cylinder 14 during different strokes of a single cycle of the cylinder. For example, directly injected fuel may be delivered at least partially during a previous exhaust stroke, during an intake stroke, and/or during a compression stroke. As such, for a single combustion event, one or multiple injections of fuel may be performed per cycle. The multiple injections may be performed during the compression stroke, intake stroke, or any appropriate combination thereof in what is referred to as split fuel injection.

Fuel tanks in fuel system 8 may hold fuels of different fuel types, such as fuels with different fuel qualities and different fuel compositions. The differences may include different alcohol contents, different water contents, different octane numbers, different heats of vaporization, different fuel blends, and/or combinations thereof, etc. One example of fuels with different heats of vaporization includes gasoline as a first fuel type with a lower heat of vaporization and ethanol as a second fuel type with a greater heat of vaporization. In another example, the engine may use gasoline as a first fuel type and an alcohol-containing fuel blend, such as E85 (which is approximately 85% ethanol and 15% gasoline) or M85 (which is approximately 85% methanol and 15% gasoline), as a second fuel type. Other feasible substances include water, methanol, a mixture of ethanol and water, a mixture of water and methanol, a mixture of alcohols, etc. In still another example, both fuels may be alcohol blends with varying alcohol compositions, wherein the first fuel type may be a gasoline alcohol blend with a lower concentration of alcohol, such as E10 (which is approximately 10% ethanol), while the second fuel type may be a gasoline alcohol blend with a greater concentration of alcohol, such as E85 (which is approximately 85% ethanol). Additionally, the first and second fuels may also differ in other fuel qualities, such as a difference in temperature, viscosity, octane number, etc. In still another example, fuel tanks in fuel system 8 may hold diesel fuel. Moreover, fuel characteristics of one or both fuel tanks may vary frequently, for example, due to day to day variations in tank refilling.

Controller 12 is shown in FIG. 1A as a microcomputer, including a microprocessor unit 106, input/output ports 108, an electronic storage medium for executable programs (e.g., executable instructions) and calibration values shown as non-transitory read-only memory chip 110 in this particular example, random access memory 112, keep alive memory 114, and a data bus. Controller 12 may receive various signals from sensors coupled to engine 10, including the signals previously discussed and additionally including a measurement of inducted mass air flow (MAF) from a mass air flow sensor 122; an engine coolant temperature (ECT) from a temperature sensor 116 coupled to a cooling sleeve 118; an exhaust gas temperature from a temperature sensor 158 coupled to exhaust passage 148 upstream of turbine 176; a profile ignition pickup signal (PIP) from a Hall effect sensor 120 (or other type) coupled to crankshaft 140; throttle position (TP) from the throttle position sensor; signal EGO from exhaust gas sensor 128, which may be used by controller 12 to determine the AFR of the exhaust gas; and an absolute manifold pressure signal (MAP) from a MAP sensor 124. An engine speed signal, RPM, may be generated by controller 12 from signal PIP. The manifold pressure signal MAP from MAP sensor 124 may be used to provide an indication of vacuum or pressure in the intake manifold. Controller 12 may infer an engine temperature based on the engine coolant temperature.

Controller 12 receives signals from the various sensors of FIG. 1A and employs the various actuators of FIG. 1A to adjust engine operation based on the received signals and instructions stored on a memory of the controller. An example method for providing EGR will be described with respect to FIG. 8.

As described above, FIG. 1A shows only one cylinder of a multi-cylinder engine. As such, each cylinder may similarly include its own set of intake/exhaust valves, fuel injector(s), spark plug, etc. It will be appreciated that engine 10 may include any suitable number of cylinders, including 2, 3, 4, 5, 6, 8, 10, 12, or more cylinders. Further, each of these cylinders can include some or all of the various components described and depicted by FIG. 1A with reference to cylinder 14.

Figure 1B:
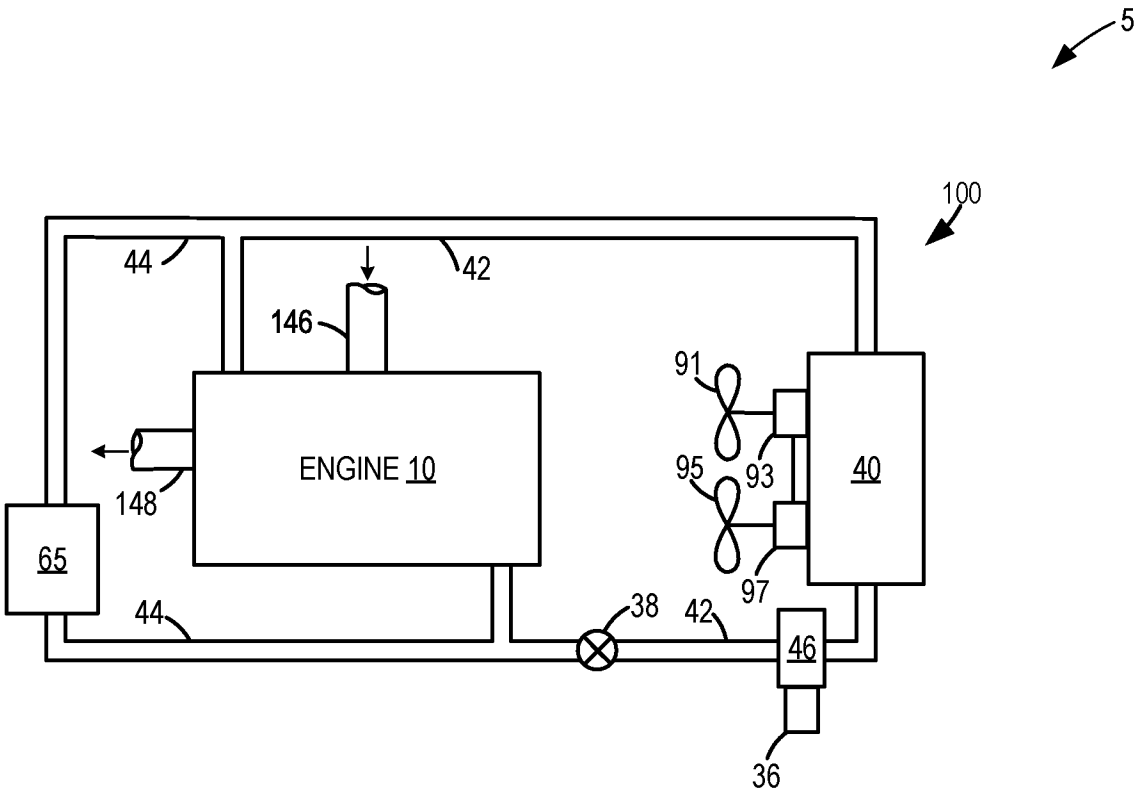
FIG. 1B schematically shows a cooling system that may be included in the vehicle system of FIG. 1A.

Continuing to FIG. 1B, a schematic depiction of an example cooling system 100 that may be included in vehicle 5 is shown. Like components of FIGS. 1A and 1B are numbered the same and may not be reintroduced. Cooling system 100 may be included in an under-hood compartment of vehicle 5, for example, which may also house engine 10. Cooling system 100 circulates coolant through engine 10 to absorb waste heat and distributes the heated coolant to a radiator 40 and/or a heater core 65 via coolant lines 42 and 44, respectively. In one example, as depicted, cooling system 100 may circulate engine coolant from engine 10 to radiator 40 via a water pump 46 and back to engine 10 via coolant line 42. Specifically, water pump 46 may circulate coolant through passages in the engine block (e.g., cooling sleeve 118 shown in FIG. 1A), cylinder head (as will be further described below with respect to FIGS. 2-7), etc., to absorb heat produced via combustion, which is then transferred via radiator 40 to ambient air. As will be elaborated herein, the cylinder head of engine 10 may include an integrated exhaust manifold and an EGR valve cartridge packaged therein. Thus, the coolant circulated by water pump 46 through the passages in the cylinder head may also cool the integrated exhaust manifold and the EGR valve cartridge. Coolant may flow through coolant line 42, as described above, and/or through coolant line 44 to heater core 65 where the heat may be transferred to a passenger compartment before the coolant flows back to engine 10. In some examples, water pump 46 may operate to circulate the coolant through each of coolant lines 42 and 44.

Water pump 46 may be driven by an electric motor 36, which may be driven using power drawn from system battery 58 (shown in FIG. 1A). As an example, controller 12 (shown in FIG. 1A) may adjust a speed of water pump 46, and therefore a flow rate of the circulating coolant, based on engine operating conditions, including engine speed and load, as well as feedback received from one or more sensors (e.g., temperature sensor 116 shown in FIG. 1). However, in other examples, water pump 46 may be coupled to the engine via a front-end accessory drive (FEAD) and rotated proportionally to engine speed via a belt, chain, etc. In one example, where water pump 46 is a centrifugal pump, the pressure (and resulting flow) produced by the pump may be proportional to the crankshaft speed, which may be directly proportional to the engine speed. The temperature of the coolant may be regulated by a thermostat valve 38, located in cooling line 42, which may be kept closed until the coolant reaches a threshold temperature.

One or more blowers (not shown) and cooling fans may be included in cooling system 100 to provide airflow assistance and augment a cooling airflow through the under-hood compartment. For example, cooling fans 91 and 95, coupled to radiator 40, may be operated when the vehicle is moving and the engine is running to provide cooling airflow assistance through radiator 40. The cooling fans may be coupled behind radiator 40 (when looking from a grille of vehicle 5 toward engine 10). Cooling fans 91 and 95 may draw a cooling airflow into the under-hood compartment through an opening in the front-end of vehicle 5, for example, through the grille (not shown). Such a cooling airflow may then be utilized by radiator 40 and other under-hood components (e.g., fuel system components, batteries, etc.) to keep the engine and/or transmission cool. Further, the airflow may be used to reject heat from a vehicle air conditioning system. While this example depicts two cooling fans, other examples may use only a single cooling fan.

Cooling fans 91 and 95 may be coupled to battery-driven motors 93 and 97, respectively. Motors 93 and 97 may be driven using power drawn from system battery 58 (shown in FIG. 1A). In some examples, motors 93 and 97 may be variable speed electric motors. In other examples, cooling fans 91 and 95 may be mechanically coupled to engine 10 via a clutch (not shown), and operating the cooling fans may include mechanically powering their rotation from engine rotational output via the clutch.

Controller 12 (shown in FIG. 1A) may adjust the operation of cooling fans 91 and 95 based on vehicle cooling demands, vehicle operating conditions, and in coordination with engine operation. In one example, during a first vehicle moving condition, when the engine is operating and vehicle cooling and airflow assistance from the fan is desired, cooling fans 91 and 95 may be powered by enabling battery-driven motors 93 and 97 to provide airflow assistance in cooling under-hood components. The first vehicle moving condition may include, for example, an engine coolant temperature that is above a threshold temperature. The threshold temperature may refer to a non-zero, positive temperature value above which airflow assistance is provided for engine cooling in order to avoid engine overheating, for example. In another example, during a second vehicle moving condition, when airflow assistance is not desired (for example, due to sufficient vehicle motion-generated airflow through the under-hood compartment), fan operation may be discontinued by disabling the fan motor. In this way, the operation of cooling system 100 may be adjusted based on a cooling demand.

Next, FIGS. 2-7 show example views of an EGR cartridge 210 packaged in an integrated exhaust manifold (IEM) cylinder head 200, which may be included in an engine. For example, the engine may be engine 10 of FIGS. 1A and 1B and may have some or all of the various components described above with respect to FIGS. 1A and 1B. FIGS. 2-7 will be described collectively, with like components numbered the same throughout FIGS. 2-7. Reference axes 299 are included in each of FIGS. 2-7 in order to compare the views and relative orientations described below.

FIGS. 2-7 show example configurations with relative positioning of the various components. If shown directly contacting each other, or directly coupled, then such elements may be referred to as directly contacting or directly coupled, respectively, at least in one example. Similarly, elements shown contiguous or adjacent to one another may be contiguous or adjacent to each other, respectively, at least in one example. As an example, components laying in face-sharing contact with each other may be referred to as in face-sharing contact. As another example, elements positioned apart from each other with only a space therebetween and no other components may be referred to as such, in at least one example. As yet another example, elements shown above/below one another, at opposite sides to one another, or to the left/right of one another may be referred to as such, relative to one another. Further, as shown in the figures, a topmost element or point of element may be referred to as a "top" of the component and a bottommost element or point of the element may be referred to as a "bottom" of the component, in at least one example. As used herein, top/bottom, upper/lower, above/below, may be relative to a vertical axis of the figures and used to describe positioning of elements of the figures relative to one another. As such, elements shown above other elements are positioned vertically above the other elements, in one example. As yet another example, shapes of the elements depicted within the figures may be referred to as having those shapes (e.g., such as being circular, straight, planar, curved, rounded, chamfered, angled, or the like). Further, elements shown intersecting one another may be referred to as intersecting elements or intersecting one another, in at least one example. Further still, an element shown within another element or shown outside of another element may be referred as such, in one example.

Turning first to FIGS. 2 and 3, FIG. 2 shows a perspective view of cylinder head 200, while FIG. 3 shows a side view of cylinder head 200 in the y-z plane (with the x-axis going into the page), as indicated by reference axes 299. Cylinder head 200 may be comprised of metal, for example. A top of the cylinder head is in the positive y-direction (e.g., in the direction of the y-axis arrow of reference axes 299) and is positioned vertically above other components of the cylinder head with respect to the page and with respect to gravity, whereas a bottom of the cylinder head is in the negative y-direction. The top of the cylinder head may be capped by a cam cover (not shown), with various valvetrain components (e.g., intake valve 150, exhaust valve 156, actuator 152, and actuator 154 of FIG. 1A) coupled between and/or within the cylinder head and the cam cover. EGR cartridge 210, including an EGR valve 216, is shown mounted to the top of cylinder head 200 (e.g., on the cam cover side) via an EGR cartridge flange 212. As will be further described below, particularly with respect to FIGS. 6 and 7, EGR cartridge 210 may be inserted in an EGR cartridge bore 220 (not visible in FIGS. 2 and 3) within cylinder head 200. FIG.

2 also shows a first dashed line 290, through which cylinder head 200 may be sectioned for the view shown in FIG. 6, and a second dashed line 292, through which cylinder head 200 may be sectioned for the view shown in FIG. 7.

As mentioned above, cylinder head 200 includes an IEM, where an exhaust manifold is integrated into cylinder head 200 instead of coupled to the cylinder head as a separate component. For example, the IEM may be cast and/or drilled into cylinder head 200 such that the cylinder head metal defines the IEM passages. As shown, cylinder head 200 may include a bore 230 for housing an exhaust gas pressure sensor configured to measure a pressure of an exhaust gas feed from an IEM exhaust port core 240 (illustrated in FIGS. 5-7 and further described below). The exhaust gas may exit the cylinder head in the negative x-direction (e.g., in the opposite direction of the x-axis arrow of reference axes 299). For example, exhaust gas may exit cylinder head 200 from IEM exhaust port core 240 via an IEM exhaust port exit 203, which may be coupled to a turbocharger turbine (e.g., turbine 176 of FIG. 1A) and other downstream exhaust system components (e.g., an emission control device, such as emission control device 178 of FIG. 1A) via a turbo flange 202. As another example, when EGR is requested and EGR valve 216 is at least partially open, a portion of the exhaust gas may exit cylinder head 200 via an EGR passage 207, as will be elaborated below with respect to FIG. 7. In some examples, a second pressure sensor may be coupled downstream of EGR cartridge 210 in EGR passage 207 to measure a delta pressure (e.g., a pressure differential) across EGR valve 216. In still other examples, a single delta pressure sensor may be coupled across EGR valve 216.

EGR passage 207 may be fluidically coupled to an EGR cooler (e.g., EGR cooler 85 of FIG. 1A) and other downstream components (e.g., intake passage 146 of FIGS. 1A and 1B) via an EGR flange 206. Thus, the EGR cooler may be positioned external to the cylinder head (and the engine). As shown in FIGS. 2 and 3, EGR passage 207 may be substantially parallel to IEM exhaust port exit 203 and positioned vertically above (e.g., in the positive y-direction, with respect to the page and with respect to gravity) IEM exhaust port exit 203. Thus, when EGR is requested and EGR valve 216 is at least partially open, exhaust gas may exit cylinder head 200 via two substantially parallel flows.

Cylinder head 200 and the components packaged therein, including IEM exhaust port core 240 and EGR cartridge 210, are cooled by a water jacket 250, the water jacket 250 having an upper jacket 252 and a lower jacket 254. For example, liquid coolant (e.g., water) may be circulated through water jacket 250 (e.g., via water pump 46 of FIG. 1B), and heat from the cylinder head, including heat from IEM exhaust port core 240 (not visible in FIGS. 2 and 3) and EGR cartridge 210, may be transferred to the liquid coolant. Water jacket 250 may include a plurality of passages for flowing coolant into and out of cylinder head 200. For example, as shown in the views of FIGS. 2 and 3, upper jacket 252 includes passages 251, 255, and 259, and lower jacket 254 includes passages 253, 257, and 261.

Figure 4:
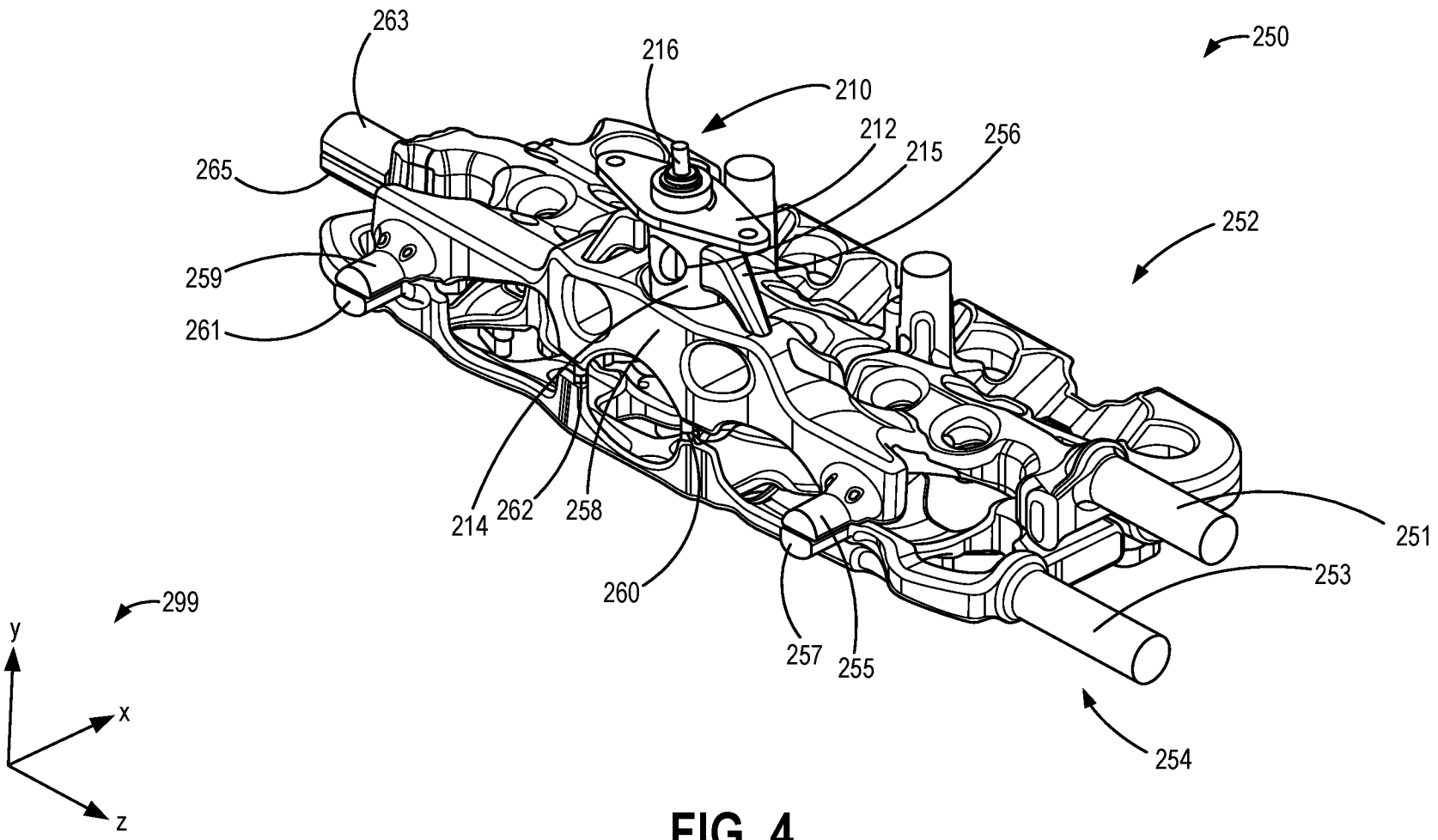
FIG. 4 shows a perspective view of the EGR valve cartridge positioned within a cylinder head water jacket that may be cast into the cylinder head of FIGS. 2 and 3.
Figure 5:
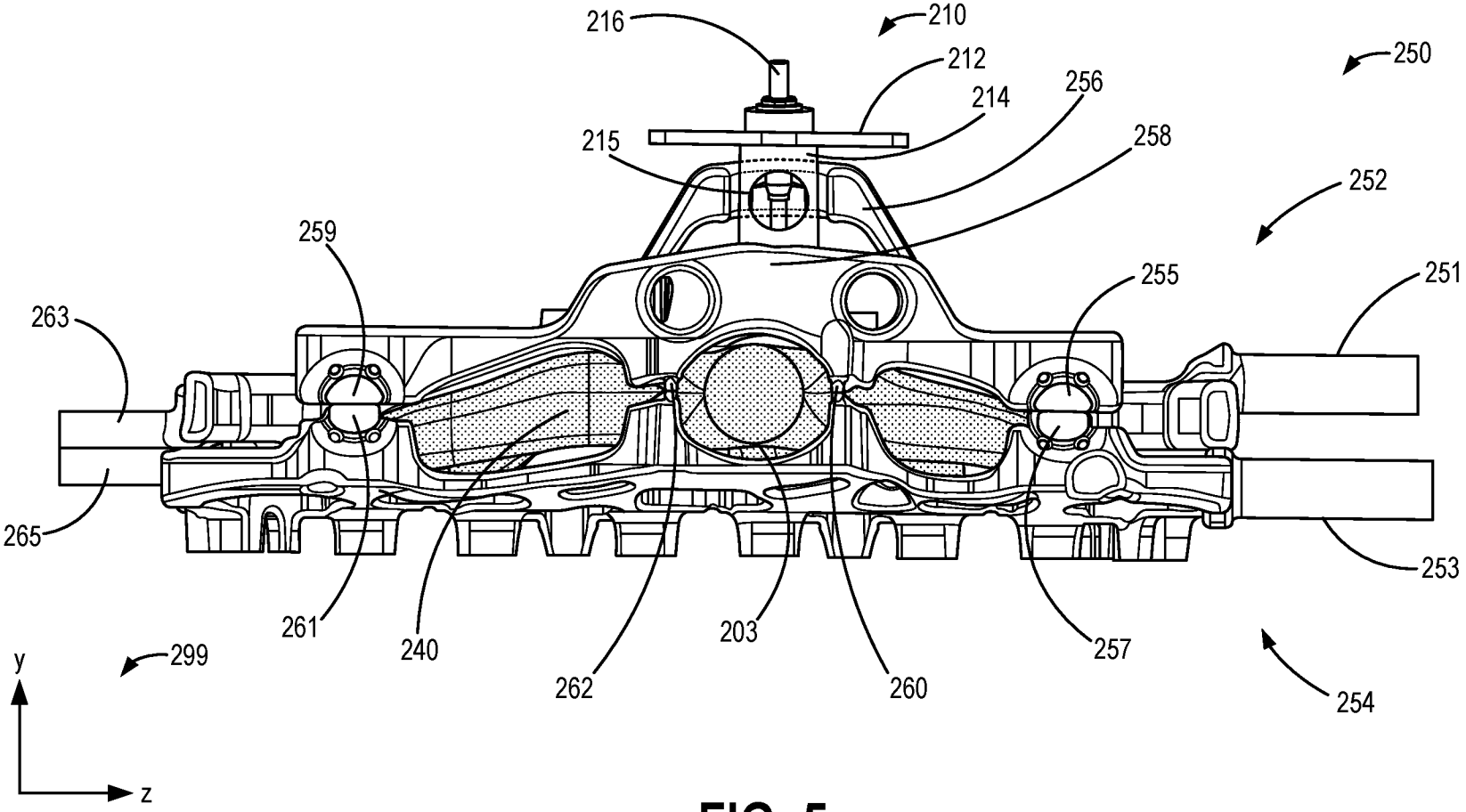
FIG. 5 shows a side view of the cylinder head water jacket of FIG. 4.

FIGS. 4 and 5 show water jacket 250 as a core, without the metal of cylinder head 200 surrounding the core. For example, FIG. 4 shows a perspective view of water jacket 250 surrounding EGR cartridge 210 that is analogous to the perspective view of FIG. 2, and FIG. 5 shows a side view of water jacket 250 surrounding EGR cartridge 210 and IEM exhaust port core 240 that is analogous to the side view of FIG. 3. As will be further described below, particularly with respect to FIGS. 6 and 7, water jacket 250 includes a series of holes and passages enclosed within cylinder head 200. For example, the holes and passages of water jacket 250 may be cast and/or drilled through cylinder head 200. A plurality of drill passages, such as drill passages 260 and 262, may serve as transfer points to fluidically couple upper jacket 252 and lower jacket 254. FIG. 5 shows drill passages 260 and 262 as positioned near IEM exhaust port exit 203 of IEM exhaust port core 240. For example, drill passages 260 and 262 may be located on either side of IEM exhaust port exit 203 and aligned along the x- and y-axes such that upper jacket 252 forms an upward arch around IEM exhaust port exit 203 between drill passage 260 and drill passage 262 and lower jacket 254 forms a downward arch around IEM exhaust port exit 203 between drill passage 260 and drill passage 262.

Further, FIGS. 4 and 5 show upper jacket 252 having an additional passage 263 and lower jacket 254 having an additional passage 265. As shown, passage 263 may be positioned on an opposite end of upper jacket 252 from passage 251, and passage 265 may be positioned on an opposite end of lower jacket 254 from passage 253. Coolant may flow through upper jacket 252 and lower jacket 254 in parallel. In one example, coolant may enter water jacket 250 via passages 251 and 253 and exit water jacket 250 via passages 263 and 265. In another example, coolant may enter water jacket 250 via passages 263 and 265 and exit water jacket via passages 251 and 253.

As shown in FIGS. 4 and 5, water jacket 250 is packaged around EGR cartridge 210. An EGR cartridge jacket core 256 is coupled to a top portion 258 of upper jacket 252 and forms an arc around a perimeter of an EGR valve housing (e.g., casing) 214 of EGR cartridge 210 (as illustrated by dashed lines in FIG. 5). As one example, EGR cartridge jacket core 256 may form a semicircular shape around EGR valve housing 214. In other examples, the arc of EGR cartridge jacket core 256 may be greater than half of a circle or less than half of a circle. EGR valve housing 214 includes an opening 215, through which exhaust gas to be recirculated may flow out of EGR valve housing 214 to EGR passage 207 (not shown in FIGS. 4 and 5). Opening 215 is positioned on the opposite side of EGR cartridge 210 as EGR cartridge jacket core 256. For example, EGR cartridge jacket core 256 may not extend around the entire circumference of EGR cartridge 210 due to the position of opening 215, which vertically overlaps with the arced portion of EGR cartridge jacket core 256. EGR valve housing 214 may be comprised of one or more metals, such as cast aluminum or cast iron.

In the example shown in FIGS. 4 and 5, EGR cartridge jacket core 256 includes two angled, tapered channels that may flow coolant between top portion 258 of upper jacket 252 and EGR cartridge jacket core 256. A cross-sectional area of each tapered channel may be smallest where the channel is coupled to top portion 258 and may gradually increase until the arced portion is reached. Further, each tapered channel may be angled such that it is furthest from EGR cartridge 210 (e.g., has a greatest horizontal distance from EGR cartridge 210 in the z-direction) where the channel is coupled to top portion 258, and the distance may gradually decrease up each channel (in the positive y-direction) until the arced portion is reached. For example, coolant may flow from top portion 258, up one tapered channel (e.g., in the positive y-direction), around the arced portion of EGR cartridge jacket core 256, and down the other tapered channel (e.g., in the negative y-direction) to flow back to top portion 258. Further, top portion 258 may substantially surround a bottom portion of EGR cartridge 210 and the EGR cartridge bore 220 within cylinder head 200 (not visible in FIGS. 4 and 5).

Water jacket 250 may cool cylinder head 200 and the components coupled therein (e.g., EGR cartridge 210) via convection due to the circulating coolant within water jacket 250. An amount of heat transferred via convection is a function of a velocity of the current flow, a surface area of contact between the coolant and cylinder head 200, a temperature difference between cylinder head 200 and the circulating coolant, and fluid properties of the coolant. Convection is a relatively fast process compared with conduction (e.g., if the coolant were not moving). Thus, a faster velocity of the coolant results in more efficient cooling of cylinder head 200 (e.g., a greater heat transfer and at a faster rate). More surface area between cylinder head 200 and the also coolant results in more efficient cooling of cylinder head 200. As an example, coolant may flow around EGR cartridge 210 at a minimum flow rate of 1 meter per second (m/s) for adequate cooling of EGR cartridge 210 to prevent degradation of the EGR cartridge components and prevent boiling of the circulating coolant. In particular, water jacket 250 may be shaped to control a velocity of the coolant flowing throughout water jacket 250 as well as the surface area of contact between the coolant and cylinder head 200, particularly the surface area adjacent to EGR cartridge 210.

FIG. 6 shows a partial section view of cylinder head 200 in the y-z plane. The y-z plane of FIG. 6 bisects EGR cartridge bore 220 along dashed line 290 shown in FIG. 2 and shows internal surfaces of water jacket 250, IEM exhaust port core 240, and EGR cartridge bore 220. Water jacket 250, IEM exhaust port core 240, and EGR cartridge bore 220 are defined by passages through cylinder head 200 that are separated by metal of the cylinder head (the cross sectional area of which is diagonally shaded). For simplicity, only the internal contours of upper jacket 252 (including top portion 258 and EGR cartridge jacket core 256), IEM exhaust port core 240, and EGR cartridge bore 220 are illustrated.

In particular, FIG. 6 shows the relative positioning of EGR cartridge bore 220 with respect to upper jacket 252 (including top portion 258 and EGR cartridge jacket core 256) and IEM exhaust port core 240. EGR cartridge bore 220 may be a cylindrical bore that is cast or drilled in cylinder head 200, extending from the top surface of the cylinder head to IEM exhaust port core 240. Thus, EGR cartridge bore 220 is not capped by the cylinder head. For example, as shown in FIG. 6, a connection area 221, where EGR cartridge bore 220 is joined to IEM exhaust port core 240, may be located within a central collector region 244 where multiple exhaust passages 241, 242 and 243 converge in the IEM exhaust port core. As one example, central collector region 244 may extend between leftmost exhaust passage 241 and rightmost exhaust passage 243. As another example, central collector region 244 may be centered at exhaust passage 242. Each of exhaust passages 241, 242, and 243 may flow exhaust gas from a single, different engine cylinder, making EGR cartridge bore 220 accessible for receiving exhaust gas from each of the different engine cylinders. In an example, connection area 221 may be positioned at exhaust passage 242, and EGR cartridge bore 220 may be directly coupled to exhaust passage 242, such as forming a junction with exhaust passage 242 at connection area 221, while being fluidically coupled to each of exhaust passages 241, 242 and 243.

The section view of FIG. 6 shows top portion 258 of upper jacket 252 on either side of a middle-to-bottom portion of EGR cartridge bore 220, vertically above connection area 221, whereas EGR cartridge jacket core 256 is positioned on either side of EGR cartridge bore 220 near the top of cylinder head 200. It may be understood that top portion 258 forms a first EGR cartridge cooling passage that fully surrounds the entire circumference of EGR cartridge bore 220 at the vertical (e.g., y-axis) positioning shown in FIG. 6. In contrast, EGR cartridge jacket core 256 may form a second EGR cooling passage that surrounds a portion of the circumference of the EGR cartridge bore 220, such as approximately half of the circumference, at the vertical positioning shown in FIG. 6. Both top portion 258 of upper jacket 252 and EGR cartridge jacket core 256 increase a surface area of circulating coolant adjacent to EGR cartridge 210. FIG. 6 additionally shows a degas vent 270 coupled to top portion 258 of upper jacket 252. By including degas vent 270 at the highest water jacket level, any gas bubbles formed within the circulating coolant may be released to atmosphere.

Further, EGR cartridge bore 220 may have a variable diameter or a constant diameter. In the example shown in FIG. 6, EGR cartridge bore 220 has a variable diameter that changes in a step-wise fashion. For example, a first, uppermost section of EGR cartridge bore 220 (e.g., in the positive y-direction) has a first, largest diameter; a second, middle section of EGR cartridge bore 220 that is directly below the first section (e.g., vertically positioned in the negative y-direction relative to the first section) has a second diameter that is smaller than the first diameter; and a third, bottom section of EGR cartridge bore 220 that is directly below the second section (e.g., vertically positioned in the negative y-direction relative to the second section) has a third diameter that is smallest than the second diameter. Each section of EGR cartridge bore 220 may have a same or different length (e.g., in the y-direction). As shown, the first section may have the longest length, and the second section may have the shortest length. The relative diameters and lengths of the different sections of EGR cartridge bore 220 may facilitate positioning of EGR cartridge 210 (not shown in FIG. 6) within EGR cartridge bore 220.

Referring to FIG. 7, a partial section view of cylinder head 200 in the x-y plane is shown. The x-y plane of FIG. 7 bisects EGR cartridge bore 220 along dashed line 292 shown in FIG. 2 and shows internal components of EGR cartridge 210 as well as the relative positioning of EGR cartridge 210 with respect to IEM exhaust port core 240 and upper jacket 252. The x-y plane of FIG. 7 is perpendicular to and intersects with the y-z plane of FIG. 6.

As shown in FIG. 7, EGR cartridge 210 includes a valve assembly contained within EGR valve housing 214. EGR valve housing 214 is a generally cylindrical cast and machined housing that houses a valve guide 228, an EGR valve seal 222, and EGR valve 216. Valve guide 228 is positioned between EGR valve 216 and EGR valve housing 214, such as directly contacting both EGR valve 216 and EGR valve housing 214, and may form a gas-tight seal between EGR valve 216 and EGR valve housing 214 while enabling EGR valve 216 to be moved in a generally vertical direction that is off-axis (e.g., tilted) from the y-axis. For example, EGR valve 216 may be reciprocated within valve guide 228 by an actuator 226, and valve guide 228 may couple EGR valve 216 within EGR valve housing 214. Valve guide 228 may facilitate alignment of EGR valve 216 with a valve seat 218, as will be further described below. EGR valve seal 222 may be coupled to valve guide 228 and may form a seal between valve guide 228 and EGR valve 216. Further, a press-in place gasket 225 (or other sealing method) is positioned between EGR cartridge flange 212 and cylinder head 200 to seal EGR cartridge 210 to cylinder head 200, as indicated by dashed boxes. Gasket 225 may be comprised of multi-layer steel, for example, and may be a face seal gasket. Additional gaskets may also be present, such as a compression radial seal within EGR cartridge bore 220, for sealing EGR cartridge 210 to cylinder head 200. Such gaskets may prevent exhaust gas from flowing around EGR cartridge 210, such as flowing between EGR valve housing 214 and the metal of cylinder head 200, and escaping to atmosphere.

EGR valve 216 is shown as a poppet valve in FIG. 7, with EGR valve housing 214 positioned within the first section of EGR cartridge bore 220. Due to the narrower diameter of the second section of EGR cartridge bore 220 relative to the diameter of EGR valve housing 214 as well as the larger width of EGR cartridge flange 212 relative to the diameter of EGR cartridge bore 220, EGR valve housing 214 sits within the first section and does not extend into the second section of the EGR cartridge bore. The bottom of EGR valve housing 214 includes an opening that forms valve seat 218 for the poppet EGR valve 216. Thus, EGR valve housing 214 includes two openings for flowing exhaust gas through EGR cartridge 210, opening 215 and valve seat 218, that are substantially perpendicular to each other (e.g., opening 215 is rotated approximately 90 degrees from valve seat 218). Further, opening 215 is positioned vertically above the opening at valve seat 218 such that opening 215 and valve seat 218 do not overlap. Additionally, opening 215 at least partially overlaps with a vertical position of valve guide 228 and fully aligns with EGR passage 207. That is, opening 215 has the same inner diameter as EGR passage 207 and has the same vertical positioning as EGR passage 207 such that opening 215 is flush with EGR passage 207 around an entire perimeter of opening 215. Further, valve seat 218 may have an angle and depth that is selected to provide desired flow properties through EGR cartridge 210.

EGR valve 216 is shown in an open position in FIG. 7, with EGR valve 216 lifted from valve seat 218 to enable a first portion of hot exhaust gas to flow from IEM exhaust port core 240, through EGR cartridge bore 220, and into EGR cartridge 210 via the bottom opening of EGR valve housing 214. As one example, the hot exhaust gas may be expelled from a cylinder 280 when a corresponding exhaust valve (not shown) is open, and the exhaust gas is directly fed to EGR cartridge bore 220 (and to EGR valve 216) from the IEM exhaust port. The hot exhaust gas exits the side of EGR cartridge 210 via opening 215 and may be directed to the intake system (e.g., as EGR) via EGR passage 207, which may be a cylindrical port machined directly into cylinder head 200. Thus, EGR valve housing 214 forms a passage between the bottom opening of the housing (e.g., at valve seat 218) and opening 215 to fluidically couple IEM exhaust port core 240 to EGR passage 207 (e.g., when EGR valve 216 is open), and the flow path of the first portion of hot exhaust gas is shown by an arrow 208. The first portion of the exhaust gas may transfer heat to EGR valve 216, EGR valve housing 214 (including valve seat 218), valve guide 228, and EGR valve seal 222 (in addition to other components of EGR cartridge 210) as it flows through EGR cartridge 210, such as via convection. In particular, a largest portion of the heat from the first portion of hot exhaust gas may be transferred to components located where the exhaust gas enters EGR cartridge 210, such as at valve seat 218, and where the exhaust gas changes direction, such as at valve guide 228. A second, remaining portion of the hot exhaust gas may be directed to the exhaust system (e.g., to a turbocharger turbine), as shown by an arrow 204, via IEM exhaust port exit 203. The first portion and the second portion may form substantially parallel flows of exhaust gas out of cylinder head 200.

Actuator 226 may actuate EGR valve 216 between the open position shown in FIG. 7 (among other possible open positions) and a fully closed position. As one example, actuator 226 may be a stepper motor. As another example, actuator 226 may be a solenoid. Actuator 226 may adjust the position of EGR valve 216 responsive to a control signal received from a controller (e.g., controller 12 of FIG. 1A) in order to vary an amount and/or flow rate of exhaust gas flowing through EGR passage 207 and to the intake system. Because EGR cartridge 210 is integrated with the cylinder head 200, actuator 226 may be the only portion of the EGR valve that is external to the engine.

When EGR valve 216 is closed (e.g., fully closed), the poppet valve is pressed against and in direct contact with valve seat 218, preventing the first portion of exhaust gas to flow through EGR valve housing 214 to EGR passage 207. Instead, all of the exhaust gas (both the first portion and the second portion) may flow to the exhaust system (e.g., the flow path shown by arrow 204). However, even when exhaust gas does not flow through EGR cartridge 210 due to the closed EGR valve 216, heat from combustion may still be transferred to EGR cartridge 210 due to its position within cylinder head 200.

In order to effectively cool EGR cartridge 210 under all engine operating conditions, a crushable metal liner 224 is positioned directly between an in direct contact with an outer circumference of EGR valve housing 214 and an inner circumference of EGR cartridge bore 220, as indicated by dashed boxes, providing a heat conduction path between EGR valve housing 214 and cylinder head 200. Metal liner 224 may be comprised of brass or another metal having a high thermal conductivity, such as at least 100 W/(m K), and provides efficient heat transfer between EGR valve housing 214 (and the components disposed therein, such as valve guide 228) to cylinder head 200 through full, direct metal-to-metal (e.g., surface) contact. For example, metal liner 224 may be in direct contact with cylinder head 200, without any voids or gaps (e.g., air pockets) between metal liner 224 and cylinder head 200, and metal liner 224 may also be in direct contact with EGR valve housing 214, without any voids or gaps between metal liner 224 and EGR valve housing 214. Further, metal liner 224 may be comprised of radial thermal conductor rings. For example, metal liner 224 may efficiently transfer heat from EGR valve housing 214 to the metal of cylinder head 200 surrounding EGR valve housing 214 and in direct contact with metal liner 224. The heat transferred to cylinder head 200 may be further transferred to the circulating coolant in upper jacket 252, particularly to the coolant within top portion 258 and EGR cartridge jacket core 256. For example, top portion 258 of upper jacket 252 overlaps with a vertical positioning of valve seat 218 to fully surround valve seat 218, and EGR cartridge jacket core 256 overlaps with a vertical positioning of valve guide 228 to partially surround valve guide 228. Thus, top portion 258 and EGR cartridge jacket core 256 are positioned to vertically overlap with hot points in EGR cartridge 210 (e.g., valve seat 218 and valve guide 228, respectively) in order to increase a rate of cooling at these hot points.

Further, coolant continues to circulate through top portion 258 and EGR cartridge jacket core 256 to maintain EGR cartridge cooling even when EGR is not provided, and heat is efficiently transferred away from EGR cartridge 210 to the circulating coolant via metal liner 224. For example, heat may be removed from the cylinder head metal adjacent to EGR cartridge 210 via convention from the coolant velocity on the inner surface of the water jacket passages that form top portion 258 and EGR cartridge jacket core 256. In this way, high heat degradation of EGR cartridge components, such as degradation of valve guide 228 and EGR valve seal 222, may be reduced or prevented.

Next, FIG. 8 shows an example method 800 for providing EGR in an engine having an EGR cartridge packaged in an IEM cylinder head, such as EGR cartridge 210 described above with respect to FIGS. 2-7. The EGR cartridge may house an EGR valve and, when the EGR valve is open, provide a passage for exhaust gas to flow from the IEM to an EGR passage internal to the cylinder head that is coupled to EGR system components external to the cylinder head, such as an EGR cooler, and to an intake of the engine. Instructions for carrying out method 800 and the rest of the methods included herein may be executed by a controller (e.g., controller 12 shown in FIG. 1A) based on instructions stored on a memory of the controller and in conjunction with signals received from sensors of the engine system, such as the sensors described above with reference to FIG. 1A. The controller may employ engine actuators of the engine system (e.g., EGR valve actuator 226 of FIG. 7) to adjust engine operation according to the methods described below.

At 802, method 800 includes estimating and/or measuring operating conditions. The operating conditions may include, for example, engine speed, engine load, engine temperature (e.g., based on signal ECT received from temperature sensor 116 of FIG. 1A), driver torque demand, manifold air flow, manifold air pressure, exhaust pressure and/or temperature, etc. The operating conditions may be measured via sensors or inferred based on available data.

At 804, method 800 includes flowing coolant around the EGR cartridge via a cylinder head water jacket. Because the EGR cartridge is internally packaged in the cylinder head, coolant passages of the cylinder head water jacket are positioned adjacent to the EGR cartridge, as described above with particular reference to FIGS. 4-7. Therefore, flowing coolant through the cylinder head water jacket results in flowing coolant around the EGR cartridge. Heat may be transferred from the EGR cartridge and the components disposed therein to the circulating coolant. As one example, the coolant may be circulated at a flow rate of at least 1 m/s via a water pump included in an engine cooling system, such as water pump 46 of cooling system 100 shown in FIG. 1B. The water pump may be an electric water pump, and the controller may operate an electric motor driving the water pump to circulate the coolant through the engine, including through the cylinder head water jacket and around the EGR valve cartridge, and to a radiator and/or a heater core, as elaborated with respect to FIG. 1B. Alternatively, the water pump may be driven by a front-end accessory drive, with the speed of the water pump proportional to engine speed, as also elaborated with respect to FIG. 1B.

At 806, method 800 includes determining if EGR is requested. As an example, EGR may be desired to attain a desired engine dilution, thereby increasing fuel efficiency and emissions quality. For example, EGR may be requested at low-to-mid engine loads. Additionally, EGR may be desired after an exhaust catalyst (e.g., emission control device 178 of FIG. 1A) has attained its light-off temperature.

If EGR is not requested, method 800 proceeds to 808 and includes maintaining current engine operating conditions without supplying EGR. As such, the EGR valve will be actuated fully closed by the EGR valve actuator or maintained fully closed, thereby blocking a flow of exhaust gas from the IEM to EGR passage. However, coolant will continue to be circulated around the cylinder head water jacket, including around the EGR cartridge, to prevent heat-related degradation of the EGR cartridge. Method 800 may then end.

Returning to 806, if instead EGR is requested, method 800 proceeds to 810 and includes determining an amount (e.g., flow rate) of EGR requested. For example, the controller may refer to a look-up table having the engine speed and load as the inputs, which may output an EGR amount (or dilution amount) corresponding to the input engine speed-load. In another example, the controller may determine the EGR amount through logic rules that directly take into account parameters such as engine load, engine speed, engine temperature, etc. In still other examples, the controller may rely on a model that correlates a change in engine load with a change in a desired dilution, and further correlates the change in the desired dilution with a change in the amount of EGR requested. For example, as the engine load increases from a low load to a mid load, the amount of EGR requested may increase, and then as the engine load increases from a mid load to a high load, the amount of EGR requested may decrease. The controller may further determine the amount of EGR requested by taking into account a best fuel economy mapping for the desired dilution.

At 812, method 800 includes opening the EGR valve to supply the requested amount of EGR. For example, the controller may determine an open position of the EGR valve by inputting the requested amount of EGR into a look-up table or map, which may output a corresponding open position of the EGR valve (or degree of opening to apply to the EGR valve). As an example, as the requested amount of EGR increases, the degree of opening of the EGR valve may be increased. The controller may transmit a control signal to the EGR valve actuator to adjust the EGR valve to the determined open position. Further, the EGR valve position may be adjusted as operating conditions, and thus the desired engine dilution, change. Additionally, coolant will continue to be circulated around the cylinder head water jacket, including around the EGR cartridge, to prevent heat-related degradation of the EGR cartridge. Following 812, method 800 ends.

In this way, EGR may be provided with a smaller flow path length and volume between an exhaust valve of a cylinder and an EGR valve, reducing time-to-torque and increasing maximum low end torque. For example, by packaging the EGR valve in a cylinder head having an integrated exhaust manifold, the EGR valve may have a direct exhaust gas feed from exhaust ports contained within the cylinder head, enabling a rapid EGR response when the EGR valve is opened. Further, by packaging the EGR valve in the IEM cylinder head, EGR system complexity may be reduced, thereby reducing a number of components and assembly costs. For example, a water jacket of the cylinder head may be engineered to cool not only the cylinder head, but the EGR valve packaged therein, eliminating an EGR valve cooling system that is external to the cylinder head. As another example, due to the reduction of EGR system components external to the cylinder head, noise, vibration, and harshness may be reduced.

The technical effect of packaging an EGR valve of an EGR system within a cylinder head having an integrated exhaust manifold is that engine performance is increased while a cost and complexity of the EGR system is decreased.

In one example, a system comprises: a cylinder head including an integrated exhaust manifold (IEM); an exhaust gas recirculation (EGR) cartridge positioned in a cylindrical bore in the cylinder head at a central collector region of the IEM, the EGR cartridge including an EGR valve positioned therein; and a water jacket enclosed within the cylinder head, the water jacket including a first cooling passage that surrounds a circumference of the EGR cartridge. In the preceding example, additionally or optionally, the EGR cartridge includes a cylindrical housing having a first opening at a bottom of the housing a second opening in a side of the housing, and wherein the housing forms a passage between the first opening and the second opening. In one or both of the preceding examples, the system additionally or optionally further comprises an EGR passage within in the cylinder head positioned vertically above and parallel to an exhaust port exit of the IEM, and wherein the second opening of the housing of the EGR cartridge is flush with the EGR passage. In any or all of the preceding examples, additionally or optionally, the EGR valve comprises a poppet valve, the first opening forms a valve seat for the poppet valve, and the first cooling passage surrounds the circumference of the EGR cartridge at a vertical position that overlaps with the valve seat. In any or all of the preceding examples, the system additionally or optionally further comprises a thermal conductor positioned between the housing of the EGR cartridge and the cylindrical bore and in direct contact with each of the housing and the cylindrical bore. In any or all of the preceding examples, additionally or optionally, the thermal conductor is a crushable metal liner. In any or all of the preceding examples, additionally or optionally, the water jacket further includes a second cooling passage positioned vertically above the first cooling passage. In any or all of the preceding examples, additionally or optionally, the second cooling passage surrounds a portion of the circumference of the EGR cartridge at a vertical position that overlaps with the second opening. In any or all of the preceding examples, additionally or optionally, the second cooling passage includes tapered channels that fluidically couple the second cooling passage to the first cooling passage. In any or all of the preceding examples, additionally or optionally, the EGR cartridge further includes a valve guide that couples the EGR valve within the cylindrical housing, and the second cooling passage surrounds a portion of the circumference of the EGR cartridge at a vertical position that overlaps with the valve guide.

As another example, a system comprises: an engine including a cylinder head, the cylinder head including an integrated exhaust manifold (IEM) and a water jacket contained therein, the water jacket including an upper jacket and a lower jacket fluidically coupled via drill passages; and an exhaust gas recirculation (EGR) system including an EGR cartridge coupled within a cylindrical bore in the cylinder head, the EGR cartridge positioned to receive engine exhaust gas directly from the IEM, and an EGR passage integrated in the cylinder head, the EGR passage fluidically coupling the EGR cartridge to a cooler positioned external to the engine. In the preceding example, additionally or optionally, a top portion of the upper jacket vertically overlaps with the EGR cartridge and fully surrounds a circumference of the EGR cartridge. In one or both of the preceding examples, additionally or optionally, the water jacket further includes an EGR cartridge core fluidically coupled to and positioned vertically above the top portion of the upper jacket. In any or all of the preceding examples, additionally or optionally, the EGR cartridge includes a valve guide positioned therein, and the EGR cartridge core surrounds a portion of the valve guide. In any or all of the preceding examples, additionally or optionally, a vertical position of the EGR cartridge core overlaps with a vertical position of the valve guide. In any or all of the preceding examples, additionally or optionally, the EGR cartridge includes a cylindrical housing with an EGR valve coupled therein, and wherein the IEM is fluidically coupled to the EGR passage when the EGR valve is in an open position. In any or all of the preceding examples, additionally or optionally, the cylindrical housing forms a valve seat for the EGR valve, and the top portion of the upper jacket fully surrounds a circumference of the valve seat.

As another example, a method comprises: flowing coolant around an exhaust gas recirculation (EGR) valve coupled in an cylinder head of an engine via a water jacket of the cylinder head, the EGR valve positioned to receive exhaust gas directly from an exhaust manifold integrated in the cylinder head; and adjusting a position of the EGR valve based on a desired EGR rate. In the preceding example, additionally or optionally, flowing coolant around the EGR valve includes flowing coolant through the water jacket at a flow rate of at least one meter per second. In one or both of the preceding examples, additionally or optionally, adjusting the position of the EGR valve based on the desired EGR rate includes adjusting the EGR valve to a further open position as the desired EGR rate increases and adjusting the EGR valve to a further closed position as the desired EGR rate decreases.

In another representation, an engine system comprises: a cylinder head including an integrated exhaust manifold (IEM); an exhaust gas recirculation (EGR) cartridge positioned in a cylindrical bore in the cylinder head, the cylindrical bore directly coupled to the IEM; and a water jacket enclosed within the cylinder head, the water jacket including one or more cooling passages that surround the EGR cartridge. In the preceding example, the engine system additionally or optionally further comprises a water pump fluidically coupled to the water jacket, the water pump configured to flow coolant through the water jacket during engine system operation. In one or both of the preceding examples, additionally or optionally, the EGR cartridge includes a cylindrical housing, the cylindrical housing thermally coupled to the cylindrical bore via a brass liner in direct contact with each of the cylindrical housing and the cylindrical bore. In any or all of the preceding examples, additionally or optionally, the EGR cartridge further includes a valve guide that couples a poppet valve to the cylindrical housing. In any or all of the preceding examples, additionally or optionally, the cylindrical housing forms a valve seat for the poppet valve. In any or all of the preceding examples, additionally or optionally, the valve seat is at a bottom-most position of the cylindrical housing and forms a first opening in the cylindrical housing. In any or all of the preceding examples, additionally or optionally, the cylindrical housing includes a second opening in a side of the cylindrical housing. In any or all of the preceding examples, additionally or optionally, the second opening is rotated 90 degrees from the first opening and overlaps with a vertical position of the valve guide. In any or all of the preceding examples, additionally or optionally, the one or more cooling passages that surround the EGR cartridge include a first cooling passage that fully surrounds a circumference of the EGR cartridge at a vertical position that overlaps with the valve seat. In any or all of the preceding examples, additionally or optionally, the one or more cooling passages that surround the EGR cartridge include a second cooling passage that partially surrounds the circumference of the EGR cartridge at a vertical position that overlaps with each of the valve guide and the second opening. In any or all of the preceding examples, additionally or optionally, the second cooling passage is positioned vertically above the first cooling passage and is fluidically coupled to the first cooling passage. In any or all of the preceding examples, additionally or optionally, during engine system operation, coolant flows from the first cooling passage to the second cooling passage and back to the first cooling passage.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example embodiments described herein, but is provided for ease of illustration and description. One or more of the illustrated actions, operations, and/or functions may be repeatedly performed depending on the particular strategy being used. Further, the described actions, operations, and/or functions may graphically represent code to be programmed into non-transitory memory of the computer readable storage medium in the engine control system, where the described actions are carried out by executing the instructions in a system including the various engine hardware components in combination with the electronic controller.

It will be appreciated that the configurations and routines disclosed herein are exemplary in nature, and that these specific embodiments are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

As used herein, the term "approximately" is construed to mean plus or minus five percent of the range unless otherwise specified.

The following claims particularly point out certain combinations and sub-combinations regarded as novel and non-obvious. These claims may refer to "an" element or "a first" element or the equivalent thereof. Such claims should be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. A system, comprising:

a cylinder head including an integrated exhaust manifold (IEM) having an upper jacket and a lower jacket with respect to a vertical axis, wherein the upper jacket and the lower jacket are part of a water jacket;

an exhaust gas recirculation (EGR) cartridge positioned in a vertical cylindrical bore in the cylinder head at a central collector region of the IEM, the EGR cartridge including an EGR valve positioned therein and extending from a top surface of the IEM downward into the vertical cylindrical bore with an EGR jacket core extending vertically the upper jacket; and wherein the water jacket is enclosed within the cylinder head, the water jacket including a first cooling passage that surrounds a circumference of the EGR cartridge, and wherein liquid coolant is circulated through the water jacket.

2. The system of claim 1, wherein a flange of the EGR cartridge is sealed to the cylinder head via a gasket positioned between the flange and the cylinder head and wherein the EGR cartridge includes a cylindrical housing having a first opening at a bottom of the cylindrical housing a second opening in a side of the cylindrical housing, and wherein the cylindrical housing forms a passage between the first opening and the second opening.

3. A system, comprising:

a cylinder head including an integrated exhaust manifold (IEM);

an exhaust gas recirculation (EGR) cartridge positioned in a cylindrical bore in the cylinder head at a central collector region of the IEM, the EGR cartridge including an EGR valve positioned therein; and a water jacket enclosed within the cylinder head, the water jacket including a first cooling passage that surrounds a circumference of the EGR cartridge, wherein the EGR cartridge includes a cylindrical housing having a first opening at a bottom of the cylindrical housing a second opening in a side of the cylindrical housing, and wherein the cylindrical housing forms a passage between the first opening and the second opening, the system, further comprising an EGR passage within the cylinder head positioned vertically above and parallel to an exhaust port exit of the IEM, and wherein the second opening of the cylindrical housing of the EGR cartridge is flush with the EGR passage.

4. The system of claim 2, wherein the EGR valve comprises a poppet valve, the first opening forms a valve seat for the poppet valve, and the first cooling passage surrounds the circumference of the EGR cartridge at a vertical position that overlaps with the valve seat.

5. The system of claim 2, further comprising a thermal conductor positioned between the cylindrical housing of the EGR cartridge and the cylindrical bore and in direct contact with each of the cylindrical housing and the cylindrical bore.

6. The system of claim 5, wherein the thermal conductor is a crushable metal liner.

7. The system of claim 2, wherein the water jacket further includes a second cooling passage positioned vertically above the first cooling passage.

8. The system of claim 7, wherein the second cooling passage surrounds a portion of the circumference of the EGR cartridge at a vertical position that overlaps with the second opening.

9. The system of claim 7, wherein the second cooling passage includes tapered channels that fluidically couple the second cooling passage to the first cooling passage.

10. The system of claim 7, wherein the EGR cartridge further includes a valve guide that couples the EGR valve within the cylindrical housing, and the second cooling passage surrounds a portion of the circumference of the EGR cartridge at a vertical position that overlaps with the valve guide.

11. A system, comprising:

an engine including a cylinder head, the cylinder head including an integrated exhaust manifold (IEM) and a water jacket contained therein, the water jacket including an upper jacket and a lower jacket fluidically coupled via drill passages; and an exhaust gas recirculation (EGR) system including an EGR cartridge coupled within a cylindrical bore in the cylinder head, the EGR cartridge positioned to receive engine exhaust gas directly from the IEM, and an EGR passage integrated in the cylinder head, the EGR passage fluidically coupling the EGR cartridge to a cooler positioned external to the engine.

12. The system of claim 11, wherein a top portion of the upper jacket vertically overlaps with the EGR cartridge and fully surrounds a circumference of the EGR cartridge.

13. The system of claim 12, wherein the water jacket further includes an EGR cartridge core fluidically coupled to and positioned vertically above the top portion of the upper jacket.

14. The system of claim 13, wherein the EGR cartridge includes a valve guide positioned therein, and the EGR cartridge core surrounds a portion of the valve guide.

15. The system of claim 14, wherein a vertical position of the EGR cartridge core overlaps with a vertical position of the valve guide.

16. The system of claim 12, wherein the EGR cartridge includes a cylindrical housing with an EGR valve coupled therein, and wherein the IEM is fluidically coupled to the EGR passage when the EGR valve is in an open position.

17. The system of claim 16, wherein the cylindrical housing forms a valve seat for the EGR valve, and the top portion of the upper jacket fully surrounds a circumference of the valve seat.

18. A method, comprising:

flowing coolant around an exhaust gas recirculation (EGR) valve coupled in a cylinder head of an engine via a water jacket of the cylinder head, the EGR valve positioned to receive exhaust gas directly from an exhaust manifold integrated in the cylinder head; and adjusting a position of the EGR valve based on a desired EGR rate, wherein flowing coolant around the EGR valve includes flowing coolant through the water jacket at a flow rate of at least one meter per second.

19. The method of claim 18, wherein adjusting the position of the EGR valve based on the desired EGR rate includes adjusting the EGR valve to a further open position as the desired EGR rate increases and adjusting the EGR valve to a further closed position as the desired EGR rate decreases.

20. The system of claim 1, wherein the liquid coolant is water.

* * * * *